US006175775B1

(12) United States Patent
Grunder

(10) Patent No.: US 6,175,775 B1
(45) **Date of Patent: *Jan. 16, 2001**

(54) METHOD FOR OPTIMIZING THE PRODUCTION OUTPUT OF AN APPARATUS PROCESSING FLAT ITEMS

(75) Inventor: Roland Grunder, Vordemwald (CH)

(73) Assignee: Grapha-Holding AG, Hergiswil (CH)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/663,635

(22) Filed: Jun. 14, 1996

(30) Foreign Application Priority Data

Jun. 22, 1995 (CH) ..... 1825/95

(51) Int. Cl.[7] ..... G06F 19/00

(52) U.S. Cl. ..... 700/111; 700/2; 700/32; 700/83; 271/3.14; 271/3.15; 271/3.17; 271/10.4; 271/122; 271/123; 271/124; 271/125; 271/126; 271/10.02; 271/10.03; 347/157

(58) Field of Search ..... 700/2, 32, 83, 700/111; 271/10.04, 22, 10.11, 314, 94, 98–99, 35, 104, 105, 122–126, 152, 160–162, 3.14, 3.15, 3.17, 10.02, 10.03, 258, 259, 265.01, 265.02, 176, 262, 263, 265.04; 493/379, 325; 347/157

(56) References Cited

U.S. PATENT DOCUMENTS

| | | | | |
|---|---|---|---|---|
| Re. 33,267 | * | 7/1990 | Kraus | 364/158 |
| 3,220,315 | * | 11/1965 | Mathias | 90/21 |
| 3,548,172 | * | 12/1970 | Centner et al. | 235/151.11 |
| 3,571,834 | * | 3/1971 | Mathias | 408/9 |
| 3,576,976 | * | 5/1971 | Russo | 364/152 |
| 3,634,664 | * | 1/1972 | Balek | 318/561 |
| 3,784,798 | * | 1/1974 | Beadle et al. | 364/474.15 |
| 4,139,216 | * | 2/1979 | Saint Clair | 281/4 |
| 4,577,852 | * | 3/1986 | Grunder | 271/188 |
| 4,578,747 | * | 3/1986 | Hideg et al. | 364/151 |
| 4,602,326 | * | 7/1986 | Kraus | 364/158 |
| 4,674,029 | * | 6/1987 | Maudal | 364/148 |
| 4,738,442 | * | 4/1988 | Rodi et al. | 271/261 |

(List continued on next page.)

FOREIGN PATENT DOCUMENTS

WO93/03990 3/1993 (WO) .

OTHER PUBLICATIONS

Zhang et al, "Intelligent Control via Learning Methods" Proceedings of the American Control Conference, Jun. 1993, International Federation of Automatic Control, pp. 39, 40.

Lundgren et al., "Design for environment can be profitable–a case study of the paper feeder in the IBM printer 4234", IEEE., pp. 128–133, 1994.*

* cited by examiner

*Primary Examiner*—William Grant
*Assistant Examiner*—McDieunel Marc
(74) *Attorney, Agent, or Firm*—Venable; Robert Kinberg; Catherine M. Voorhees

(57) ABSTRACT

A method and an apparatus for optimizing a production output of a processing device for processing flat articles, the processing device including at least one processing arrangement for receiving and processing the flat articles and which has function parameters controllable through actuators. Actual values of the function parameters are detected. Deviations of the actual values of the function parameters from set values are thereafter evaluated according to an empirically determined algorithm. A correction value for at least one of the actuators is calculated based on results of the above evaluation, and the actuator is operated based on the correction value for controlling the function parameters.

13 Claims, 1 Drawing Sheet

U.S. PATENT DOCUMENTS 4,879,643 * 11/1989 Chakravarty et al. ..... 364/148
4,966,354 * 10/1990 Grunder ..... 270/56
4,995,745 * 2/1991 Yokoi et al. ..... 400/605
5,041,850 * 8/1991 Kahoyashi et al. ..... 347/157
5,251,891 * 10/1993 Blaser et al. ..... 271/176
5,394,322 * 2/1995 Hansen ..... 364/148
5,406,474 * 4/1995 Hansen ..... 364/148
5,419,678 * 5/1995 Erb ..... 414/797
5,445,372 * 8/1995 Blaser et al. ..... 206/459.5
5,543,826 * 8/1996 Kuronuma et al. ..... 347/23
5,587,896 * 12/1996 Hansen et al. ..... 364/148
5,592,683 * 1/1997 Chen et al. ..... 710/52
5,664,073 * 9/1997 Faes et al. ..... 395/112
5,673,190 * 9/1997 Kahleck et al. ..... 364/131
5,729,268 * 3/1998 Akimoto ..... 347/119

METHOD FOR OPTIMIZING THE PRODUCTION OUTPUT OF AN APPARATUS PROCESSING FLAT ITEMS

CROSS-REFERENCE TO RELATED APPLICATION

This application claims the priority of Patent Application Serial No. 01 825/95-7 filed in Switzerland on Jun. 22, 1995, the subject matter of which is incorporated herein by reference.

1. Field of the Invention

The invention relates to a method and apparatus for optimizing the production output of a processing device for processing flat articles (e.g.: bound products, paper sheets or printed sheets and inserts), which processing device includes at least one processing arrangement for receiving and processing the flat articles, the processing arrangement having function parameters which are controllable by way of actuators.

2. Background of the Invention

In feeders of processing devices such as perfect binders, thread-stitchers, folding machines, gathering and stitching machines, collating machines and/or Einck machines for the production of flat articles such as magazines, books, brochures and the like, the function parameters of a given processing arrangement are adjusted and set manually when the machines are not in operation if malfunctions occur during processing. A manual setting of the function parameters of the feeders is time-consuming, results in a decrease in productivity, and is further made even more difficult by the complex relationships existing between different function parameters of a given processing arrangement. These interrelationships are sometimes not easily comprehended by the individuals operating the processing device.

Moreover, precision and control suffer when manual setting methods are used, which phenomenon affects the functional reliability of the processing device. A monitoring of the operation of the processing device in order to ensure precision and control is usually difficult as well.

SUMMARY OF THE INVENTION

It is therefore an object of the present invention to set forth a method and an apparatus of the type previously mentioned by means of which the productivity of a processing device for processing flat articles can be increased without affecting the quality of operation.

The above object, and many others which will become apparent as the description progresses, are accomplished according to the invention, which concerns a method and an apparatus for optimizing a production output of a processing device for processing flat articles, the processing device including at least one processing arrangement to which the flat articles are supplied and which has function parameters controllable by actuators.

The method of the present invention involves the steps of detecting actual values of the function parameters by way of sensors; evaluating deviations of the actual values of the function parameters from set values according to an empirically determined algorithm; calculating a correction value for at least one of the actuators based on results of the evaluating step; and operating the at least one of the actuators based on the correction value for controlling the function parameters.

As a result of the method of the invention, the function parameters of a processing arrangement can be adjusted to exigent conditions and requirements more accurately than has been the case in the past, malfunction influences can be reduced, and the processing speed can thereby be increased. Further, the setting times can be reduced dramatically.

The method can be further improved and the adjustment times can be further reduced, if the algorithm is configured such that it can be changed or that it can be adjusted to changed conditions.

It is advantageous if the algorithm and/or the set values are changed or adjusted by way of a control which is able to learn, i.e. is provided with a computing intelligence based on the behavior of the function parameters, for example, in the form of an adaptive control unit.

Here it is preferred if the adaptive control unit, which controls at least one function parameter, is allocated to a set value/actual value reference controller of an arrangement of the processing operation.

Therefore, according to further embodiments of the invention, the method described above includes the further step of adjusting at least one of the set values and the algorithm to changed conditions of the processing arrangement. The above adjusting step may include the step of utilizing an adaptive control unit which is responsive to the changed conditions of the processing arrangement.

The step of evaluating may include the step of utilizing a reference controller for each of the actuators, at least one reference controller being connected to the adaptive control unit and being superordinate thereto.

The inventive apparatus is implemented in a processing device for processing flat articles. The processing device includes at least one processing arrangement for receiving and processing the flat articles, which processing arrangement comprises processing components for processing the flat articles, control elements for controlling a processing of the flat articles by the processing components, and actuators connected to the control elements for driving the control elements thereby controlling the function parameters of the processing arrangement. The inventive apparatus includes sensors effective for sensing actual values of the function parameters, and a control arrangement connected to the actuators and to the sensors. The control arrangement includes reference controllers connected to respective ones of the actuators and corresponding ones of the sensors and being effective for generating controller outputs according to an algorithm and for transmitting the controller outputs to corresponding ones of the actuators for setting respective ones of the control elements thereby controlling the function parameters. The control arrangement further includes an adaptive control unit connected to the reference controllers and receiving actual values from the sensors, the adaptive control unit being superordinate to the reference controllers for adjusting the algorithm of the reference controllers and the outputs thereof.

According to one aspect of the inventive apparatus, the reference controllers transmit their controller outputs to the adaptive control unit.

According to yet another aspect of the inventive apparatus, the adaptive control unit is connected to the reference controllers to determine the internal state of the reference controllers.

According to a further aspect of the inventive apparatus, the adaptive control unit comprises a read-write data memory.

The apparatus according to the invention may further include a plurality of interconnected processing arrangements where the adaptive control units of the plurality of interconnected processing arrangements are connected to one another.

BRIEF DESCRIPTION OF THE DRAWING

These and other features and advantages of the invention will be further understood from the following detailed description of the preferred embodiment with reference to the accompanying drawing to which reference is expressly made with regard to all specifics which are not mentioned in detail in the description.

DETAILED DESCRIPTION OF THE PREFERRED EMBODIMENT

Figure 1:
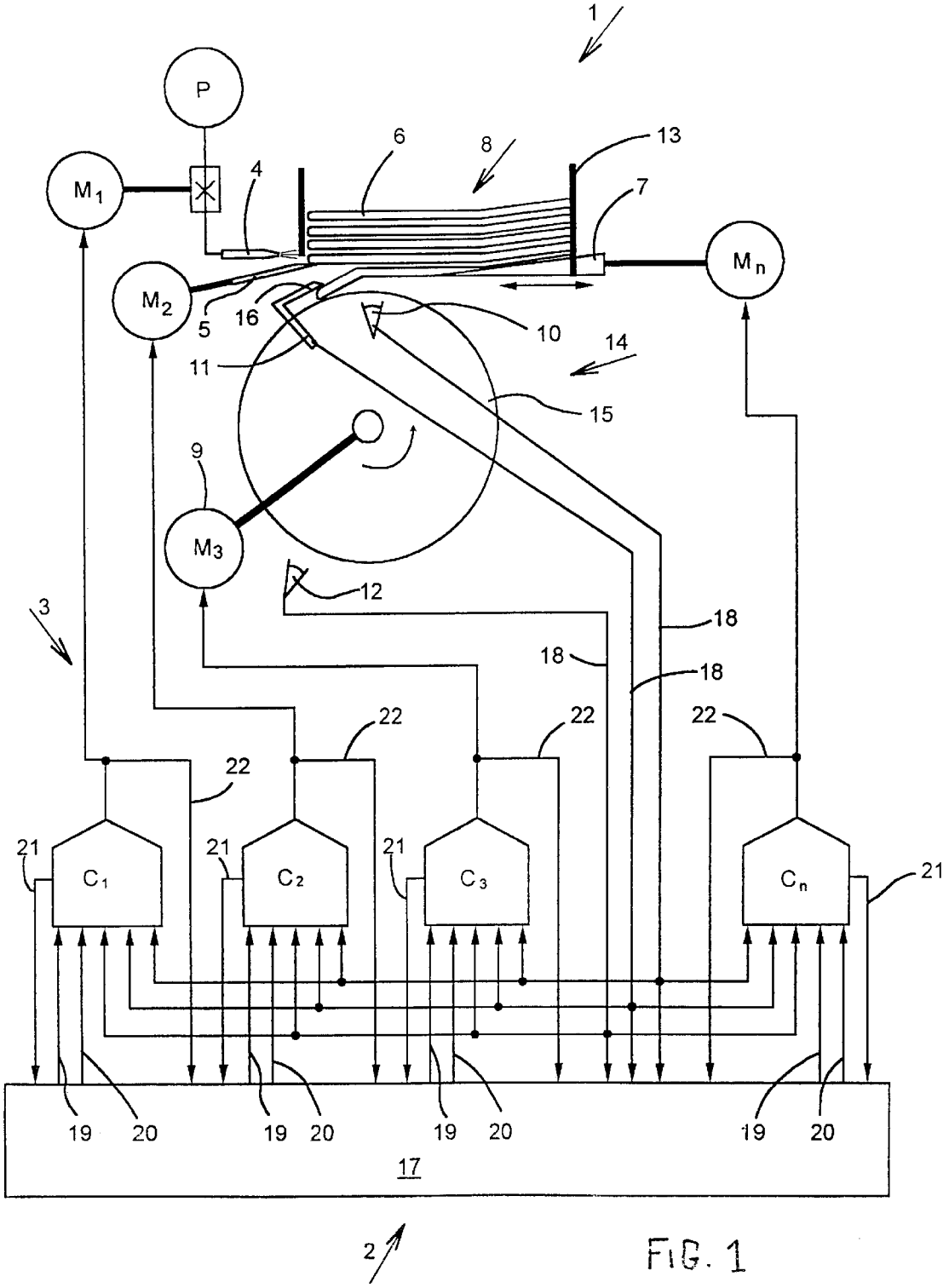
FIG. 1 is a schematic and block circuit diagram which shows a processing arrangement of a processing device for flat items, which processing arrangement includes a control arrangement according to the invention.

FIG. 1 shows a processing arrangement of a processing device for flat items according to the invention. In the drawing, a printed-sheet feeder 1, together with a control arrangement 2, forms an apparatus 3 for implementing the method according to the invention. Printed-sheet feeder 1 is thus a processing arrangement which may be used in a processing device such as a perfect binder, a thread stitcher, a folding machine, a gathering and stitching machine, a collating machine or an Einck machine.

The illustrated printed-sheet feeder includes actuators identified by $M_1$ through $M_n$, which are respectively allocated to corresponding adjustable control elements of printed-sheet feeder 1 for controlling the various function parameters of the processing arrangement. The illustrated adjustable control elements include, for example, nozzles 4, which carry separating air directed at the face of the shown stack of printed sheets 8, separating needles 5, which serve as a separating aid for separating the lowest printed sheet 6 of the stack of printed sheets 8, a wedge 7, which is effective for stabilizing the printed sheets, and which is configured so that it may be inserted under or pulled out from under the stack of printed sheets 8, and an adjustable drive arrangement 9, which may include a motor having gears for changing the rpm of the printed-sheet feeder. The control elements influence the function parameters of the printed-sheet feeder 1.

In addition, the illustrated printed-sheet feeder includes sensors which sense the function parameters of the processing arrangement, such as, for example, optical sheet position monitoring device 10, sheet thickness measuring device 11, and sheet feed monitoring device 12. It is clear from the above that the function parameters are indicative of a physical processing of the flat articles.

Printed-sheet feeder 1 further includes processing components such as a printed-sheet magazine 13 and a rotating gripper system 14, which comprises a drum 15 and grippers 16. The processing components are thus effective for processing the printed sheets with the aid of the control elements described above.

The control arrangement 2 comprises individual reference controllers identified by $C_1$ through $C_n$, which are respectively allocated to corresponding actuators $M_1$ through $M_n$ for controlling corresponding ones of the adjustable control elements 4, 5, 7, 9 and 16. In addition, the control arrangement includes an adaptive control unit 17 which is connected both to the controllers and to the several sensors 10, 11 and 12. The internal state of the controllers and the outputs of the controllers are supplied to the adaptive control unit. Adaptive control unit 17 is thus effective for monitoring both the controllers, and for receiving measured values transmitted from the sensors. Moreover, each controller may be connected to several ones of the sensors, and, while not every controller utilizes all measured values of the sensors, every controller utilizes at least one of the measured values.

For the purpose of monitoring the processing operation of the printed-sheet feeder, or for indirectly influencing the processing operation particularly by way of adjusting the empirically determined set values and/or algorithms for each of the function parameters, the internal state (i.e. the signals processed within the controllers) and the output signals of the controllers are supplied to the adaptive control unit 17 via lines 21 and 22, respectively.

In a processing device which includes a number of processing arrangements such as apparatus 3 operating according to the present invention, the various apparatuses may be connected for data exchange purposes.

It will be understood that the above description of the present invention is susceptible to various modifications, changes and adaptations, and the same are intended to be comprehended within the meaning and range of equivalents of the appended claims.

What is claimed is:

1. A method for optimizing a production output of a processing device for processing flat articles, the processing device including at least one feeder which receives and processes the flat articles and which has function parameters indicative of a physical processing of the flat articles, the function parameters being controllable by actuators, the method comprising the steps of:

detecting actual values of the function parameters by way of sensors;

evaluating deviations of the actual values of the function parameters from set values according to an empirically determined algorithm;

calculating a correction value for at least one of the actuators based on results of the evaluating step; and operating the at least one of the actuators based on the correction value for controlling the function parameters.

2. The method according to claim 1, further including the step of adjusting at least one of the set values and the algorithm to changed conditions of the processing arrangement.

3. The method according to claim 2, wherein the step of adjusting includes the step of utilizing an adaptive control unit which is adaptive based on a behavior of the function parameters.

4. The method according to claim 3, wherein the step of evaluating includes the step of utilizing a reference controller for each of the actuators, at least one reference controller being connected to the adaptive control unit and being subordinate thereto.

5. A method for optimizing one of gathering, assembling, perfect binding, thread stitching, inserting and cutting printed sheets, comprising utilizing the method of claim 1.

6. A method according to claim 1, wherein the step of detecting actual values includes monitoring an optical sheet position, measuring sheet thickness and monitoring the sheet feed.

7. In a processing device for processing flat articles, the processing device including at least one processing arrangement for receiving and processing the flat articles, the processing arrangement including:

a plurality of operatively connected processing components for processing the flat articles;

a plurality of control elements operatively connected to corresponding ones of the processing components for controlling a processing of the flat articles by the processing components;

a plurality of actuators connected to respective ones of the control elements for driving the control elements thereby controlling function parameters of the processing arrangement indicative of a physical processing of the flat articles;

wherein the improvement comprises an apparatus for optimizing a production output of the processing device, the apparatus including:

a plurality of sensors effective for sensing actual values of the function parameters of the processing arrangement; and a control arrangement connected to the actuators and to the sensors and including:

a plurality of reference controllers connected to respective ones of the actuators and corresponding ones of the sensors, the reference controllers being effective for generating controller outputs according to an algorithm and for transmitting the controller outputs to corresponding ones of the actuators for setting respective ones of the control elements thereby controlling the function parameters; and an adaptive control unit connected to the reference controllers and receiving actual values from the sensors, the adaptive control unit being superordinate to the reference controllers for adjusting the algorithm of the reference controllers and the outputs thereof.

8. The apparatus according to claim 7, wherein the controller outputs are coupled to the adaptive control unit.

9. The apparatus according to claim 7, wherein the adaptive control unit is connected to the reference controllers for determining an internal state of the reference controllers.

10. The apparatus according to claim 7, wherein the adaptive control unit comprises a read-write data memory.

11. The apparatus according to claim 7, wherein:

the at least one processing arrangement includes a plurality of interconnected processing arrangements; and adaptive control units of the plurality of interconnected processing arrangements are connected to one another.

12. A method for performing one of gathering, assembling, perfect binding, thread stitching, inserting and cutting printed sheets which comprises utilizing the apparatus of claim 7.

13. The apparatus according to claim 7, wherein the at least one processing arrangement is a feeder and the function parameters include sheet position, sheet thickness and sheet feed.

* * * * *